United States Patent [19]

Engelbach

[11] Patent Number: 5,060,857

[45] Date of Patent: Oct. 29, 1991

[54] BUBBLER

[75] Inventor: Brian W. Engelbach, Mansfield, Ohio

[73] Assignee: Therm-O-Disc, Incorporated, Mansfield, Ohio

[21] Appl. No.: 482,041

[22] Filed: Feb. 20, 1990

[51] Int. Cl.[5] ..... B05B 12/14

[52] U.S. Cl. ..... 239/32; 239/30; 239/288.3; 239/600; 222/542; 285/423

[58] Field of Search ..... 222/189, 545, 568, 559, 222/542; 403/199, 200; 239/32, 31, 30, 29, 28, 24, 288, 288.3, 600; 285/412, 238, 239, 245, 423, 174, 242

[56] References Cited

U.S. PATENT DOCUMENTS

| | | | |
|---|---|---|---|
| 2,234,557 | 3/1941 | Hungerford | 403/200 X |
| 2,474,286 | 6/1949 | Snyder | 239/25 |
| 4,009,806 | 3/1977 | Dreibelbis et al. | 222/545 |
| 4,220,358 | 9/1980 | Gaffney | 285/242 |
| 4,679,405 | 7/1987 | Mitchell et al. | 285/239 X |
| 4,738,042 | 4/1988 | Corden et al. | 40/584 X |

*Primary Examiner*—Kevin P. Shaver
*Assistant Examiner*—Gregory L. Huson
*Attorney, Agent, or Firm*—Jones, Day, Reavis & Pogue

[57] ABSTRACT

A bubbler includes a plastic valve body having a cavity for receiving an internally threaded metal mounting base and a pocket for receiving a flow regulator. Screws are threaded into holes in the valve body for holding a metal mounting base and a flow regulator in the cavity and pocket. A plastic shield is mounted to the valve body with a snap fit.

19 Claims, 5 Drawing Sheets

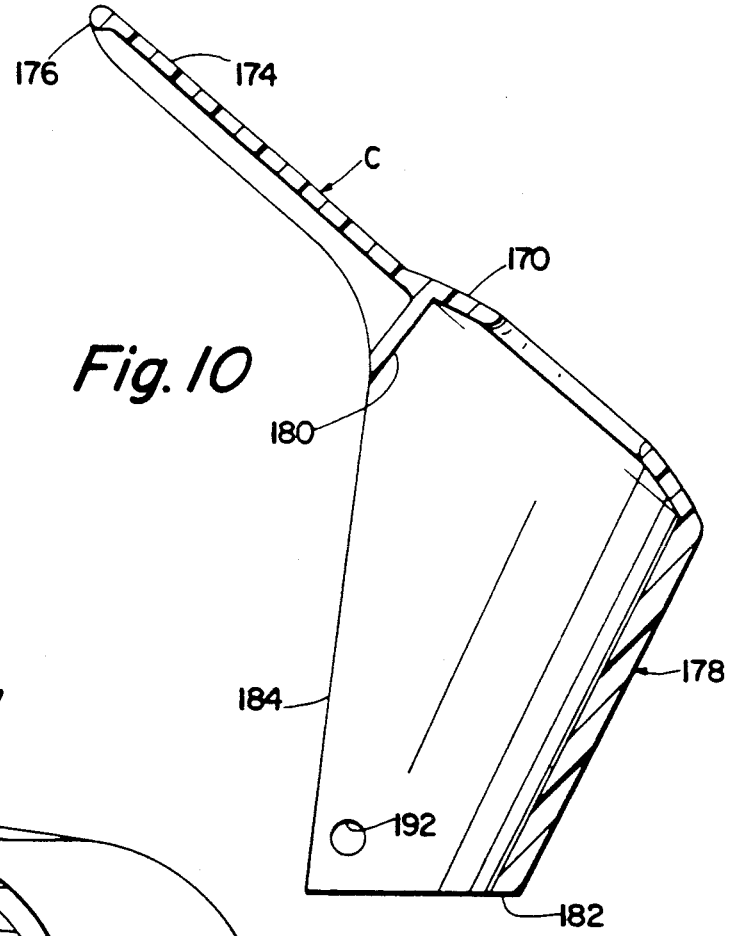
Fig. 10
Fig. 11
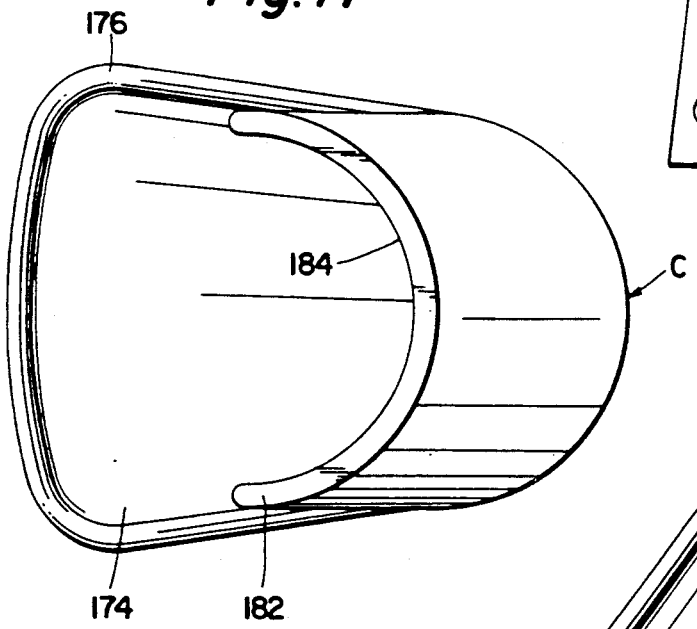
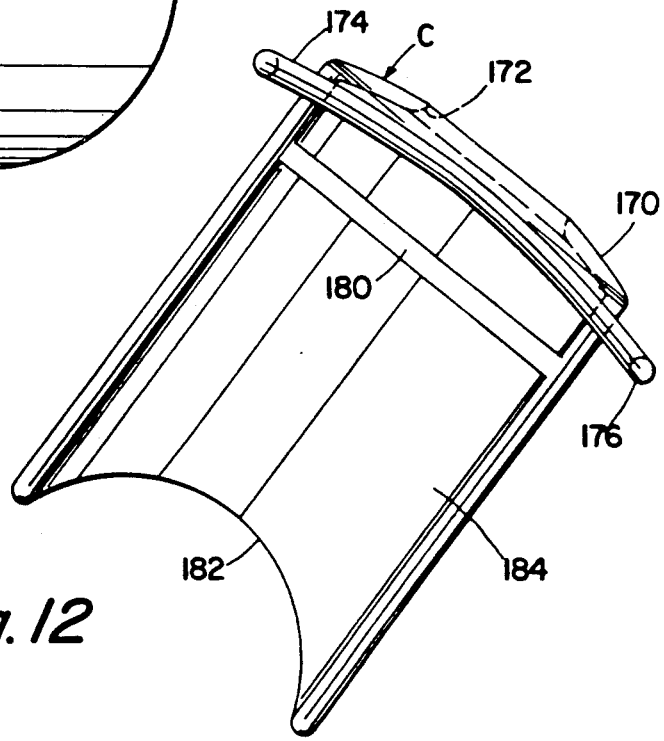
Fig. 12

BUBBLER

BACKGROUND OF THE INVENTION

This application relates to the art of valves and, more particularly, to valves of the type used for controlling flow of liquids. The invention is particularly applicable to bubbler valves used on drinking fountains and will be described with specific reference thereto. However, it will be appreciated that certain features of the invention have broader aspects and can be used in other types of valves.

A bubbler valve of a known type is disclosed in U.S. Pat. No. 4,009,806 issued Mar. 1, 1977, to Richard C. Dreibelbis, et.al. This bubbler includes a plastic valve body to which a metal mounting base is ultrasonically welded. A metal insert is also ultrasonically welded in a flow regulator cavity for use in securing a flow regulator and a shield to the valve body. In this arrangement, the plastic valve body is prone to cracking due to stresses induced by the ultrasonically welded metal inserts. Also, weld lines in the plastic material result in weak parts.

It would be desirable to have a way of attaching a metal mounting base, a flow regulator and a shield to a plastic valve body so that stress in the plastic material is minimized.

SUMMARY OF THE INVENTION

A bubbler valve of the type described includes a plastic valve body having a cavity for receiving a metal mounting base and a pocket for receiving a flow regulator. Screws are threaded into a plurality of holes around the cavity and pocket for securing a metal mounting base and a flow regulator to the valve body.

In a preferred arrangement, the metal mounting base has an outwardly extending flange engaging a shoulder surrounding the cavity in the plastic valve body. A circumferential chamfer extends between the cavity and shoulder, and an O-ring is in sealing engagement with the chamfer and the metal mounting base.

The screw receiving holes around the pocket for receiving the flow regulator are in circumferentially-spaced bosses. The plastic valve body is laterally open between adjacent bosses. A metal retainer is positioned over a flow regulator received in the pocket, and screws threaded into the holes in the bosses cooperate with the retainer for holding the flow regulator in position. The retainer preferably has laterally open slots in which the screws are received for allowing disengagement of the retainer from the screws by lateral movement thereof when the screws are slightly loosened.

An outlet spout is received in a bore in the plastic valve body. The outlet spout has a circumferential groove receiving an O-ring that compressively engages the peripheral wall of the bore to retain the outlet spout within the bore. A circumferential shoulder in the bore is engaged by the outlet spout for proper positioning thereof.

A plastic shield is attached to the plastic valve body by the use of cooperating lugs and recesses on the valve body and shield. The shield has an elongated flexible shield tongue having a smoothly rounded bead on its outer periphery to eliminate sharp edges.

It is a principal object of the invention to provide an improved plastic valve body for a bubbler valve.

It is another object of the invention to provide a plastic valve body having an improved arrangement for attaching a metal mounting base thereto.

It is a further object of the invention to provide a plastic valve body having an improved arrangement for attaching a flow regulator cartridge thereto.

It is an additional object of the invention to provide a plastic valve body having an improved arrangement for attaching an outlet spout thereto.

It is also an object of the invention to provide an improved plastic shield for attachment to a plastic valve body, along with an improved way of attaching a shield to a valve body.

BRIEF DESCRIPTION OF THE DRAWING

FIG. 10 is a cross-sectional elevational view taken generally on line 10—10 of FIG. 9;

FIG. 11 is a bottom plan view taken generally on line 11—11 of FIG. 8; and FIG. 12 is an elevational view taken generally on line 12—12 of FIG. 8.

DESCRIPTION OF A PREFERRED EMBODIMENT

Figure 1:
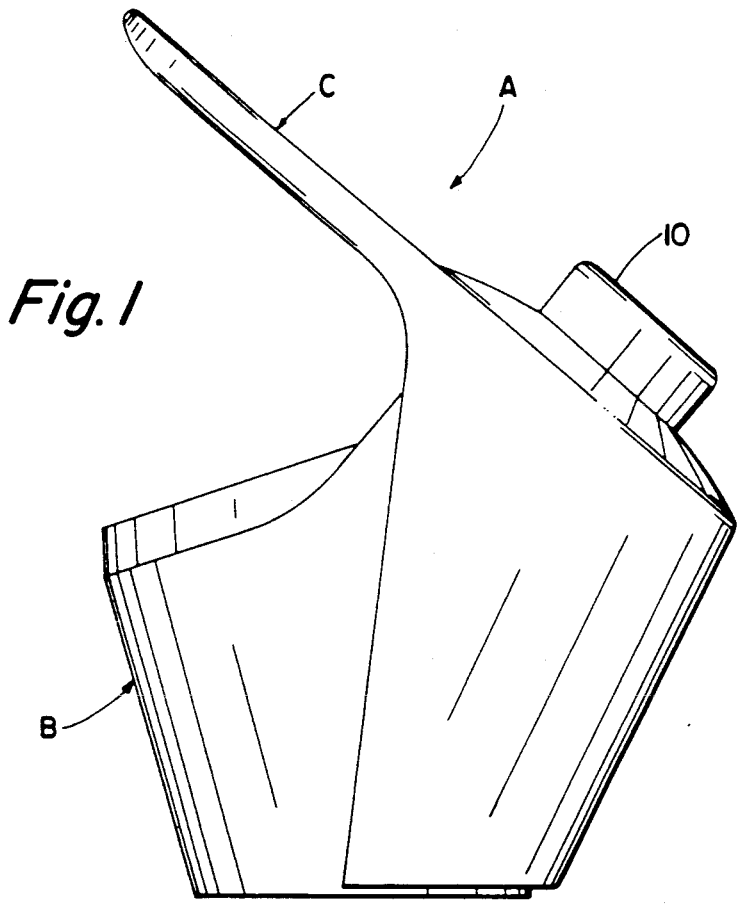
FIG. 1 is a side elevational view of a bubbler valve constructed in accordance with the present application.
Figure 2:
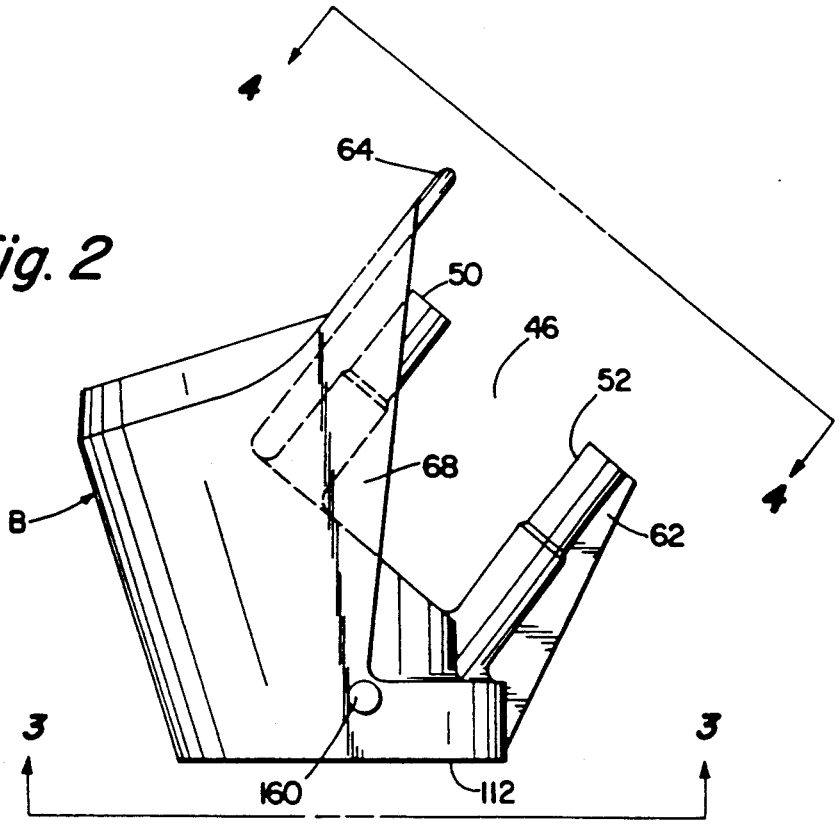
FIG. 2 is a side elevational view of a plastic valve body constructed in accordance with the present application.

Referring now to the drawings, wherein the showings are for purposes of illustrating a preferred embodiment of the invention only and not for purposes of limiting same, FIG. 1 shows a bubbler A for use on drinking water fountains. Bubbler A includes a one-piece plastic valve body B having a one-piece plastic shield C attached thereto. A manually operable button 10 extends through a suitable opening in shield C for operating a flow regulator valve mounted on valve body B.

Figure 3:
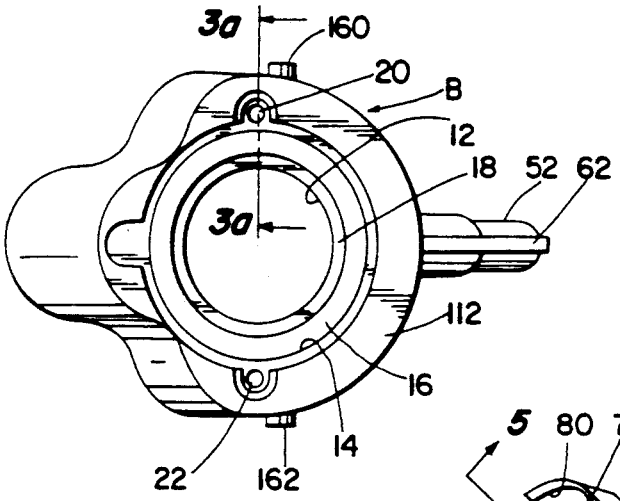
FIG. 3 is a bottom plan view taken generally on line 3—3 of FIG. 2.
Figure 4:
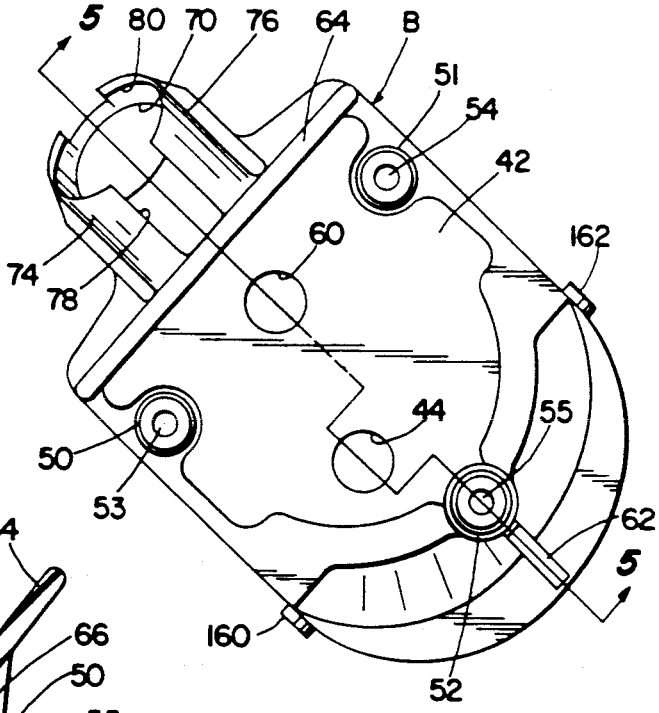
FIG. 4 is a plan view taken generally on line 4—4 of FIG. 2.
Figure 5:
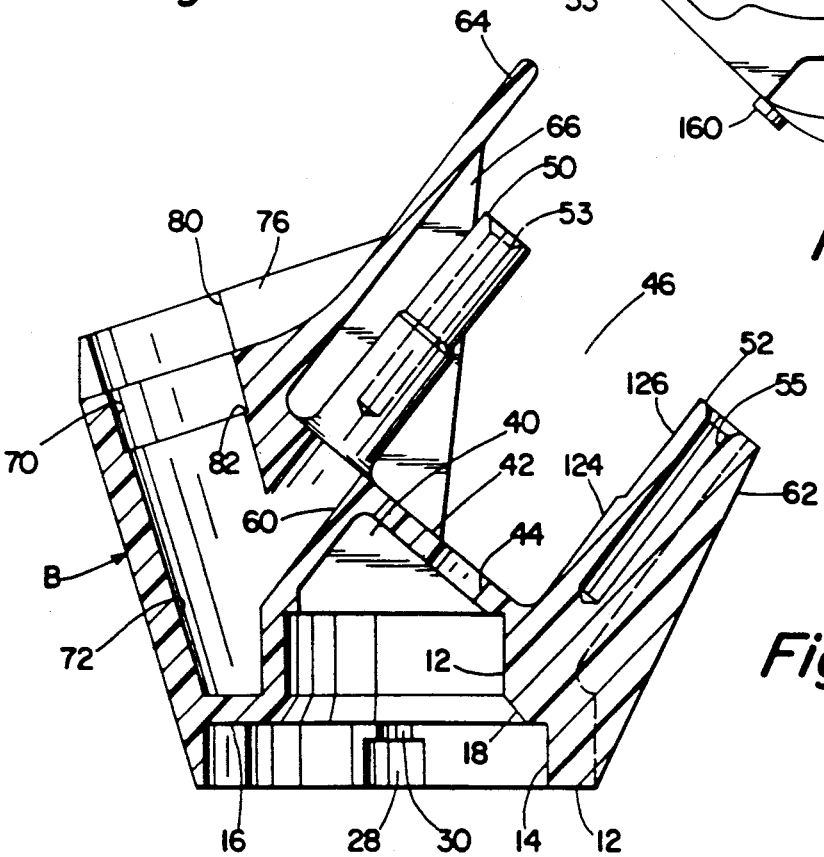
FIG. 5 is a cross-sectional elevational view taken generally on line 5—5 of FIG. 4.

Details of valve body B are shown in FIGS. 1–7. Referring to FIG. 5, valve body B has a cavity 12 in the bottom portion thereof for receiving a metal mounting base that is attachable to a water supply fitting on a water fountain. A circular recess 14 extends upwardly into the bottom of valve body B, and has a larger diameter than cylindrical cavity 12 and is substantially concentric therewith. Recess 14 provides a flat circumferential shoulder 16 between recess 14 and cavity 12. A circumferential chamfer 18 extends between cavity 12 and shoulder 16, and intersects the plane of shoulder 16 at an included angle of about 45° .

Figure 3A:
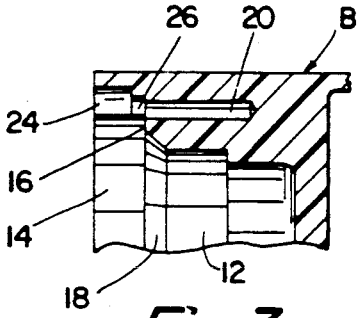
FIG. 3*a* a partial cross-sectional elevational view taken generally on-line 3*a*–3*a* of FIG. 3.

With reference to FIGS. 3 and 3*a*, the bottom of valve body B has a pair of opposite screw receiving holes 20, 22 therein outwardly of recess 14. Screw receiving holes 20, 22 are adapted to receive retaining screws for retaining a metal mounting base within cavity 12. The entrances to retaining screw receiving holes 20, 22 are provided with stepped countersinks as shown as 24, 26 for hole 20 in FIG. 3*a*, and at 28, 30 for hole 22 in FIG. 5.

Referring to FIG. 5, a hollow space 40 above cavity 12 has a wall 42 with an inlet opening 44 therethrough communicating with hollow space 40 and with a pocket generally indicated at 46 for receiving a flow regulator valve. Three circumferentially-spaced elongated bosses 50–52 define pocket 46 of FIG. 5. Valve body B is laterally open outwardly between adjacent ones of bosses 50–52. Each boss 50–52 has a screw receiving hole 53–55 therein for receiving a holding screw for holding a flow regulator valve within pocket 46.

A water outlet opening 60 extends through wall 42 centrally between bosses 50, 51. As shown in FIG. 4, water inlet and outlet openings 44, 60 are laterally offset from one another. Water outlet opening 60 lies on the left-to-right centerline of valve body B, while water inlet opening 44 is laterally offset therefrom. A flow regulator cartridge having inlet and outlet nipples receivable in openings 44, 60 is insured of proper positioning in pocket 60 because of the lateral offset of openings 44, 60. Thus, the flow regulator cartridge cannot be positioned in the pocket with the inlet and outlet nipples received in the wrong holes.

A narrow rib 62 extends along the rear of boss 52 for supporting a shield as will be described hereafter. A relatively thin flat wall 64 extends upwardly from valve body B in spaced relationship to bosses 50, 51 and substantially parallel thereto. Wall 64 extends outwardly a substantially greater distance than bosses 50–52. Reinforcing walls extend between the opposite sides of wall 64 and wall 42 outwardly of bosses 50, 51 for supporting wall 64. One such reinforcing wall is shown at 66 in FIG. 5, and the other such reinforcing wall is shown at 68 in FIG. 2.

Referring to FIG. 5, an outlet spout receiving bore 70 is provided in valve body B, and communicates with outlet opening 60 through a flow passage 72. A pair of spaced-apart channel forming walls 74, 76 are located on opposite sides of the center of outlet spout receiving bore 70, and have an elongated channel 78 therebetween centered on bore 70. An enlarged cylindrical recess 80 is provided between channel forming walls 74, 76 concentric with outlet spout receiving bore 70. An outwardly facing circumferential shoulder 82 is provided between outlet spout receiving bore 70 and flow passage 72 as shown in FIG. 5.

Figure 6:
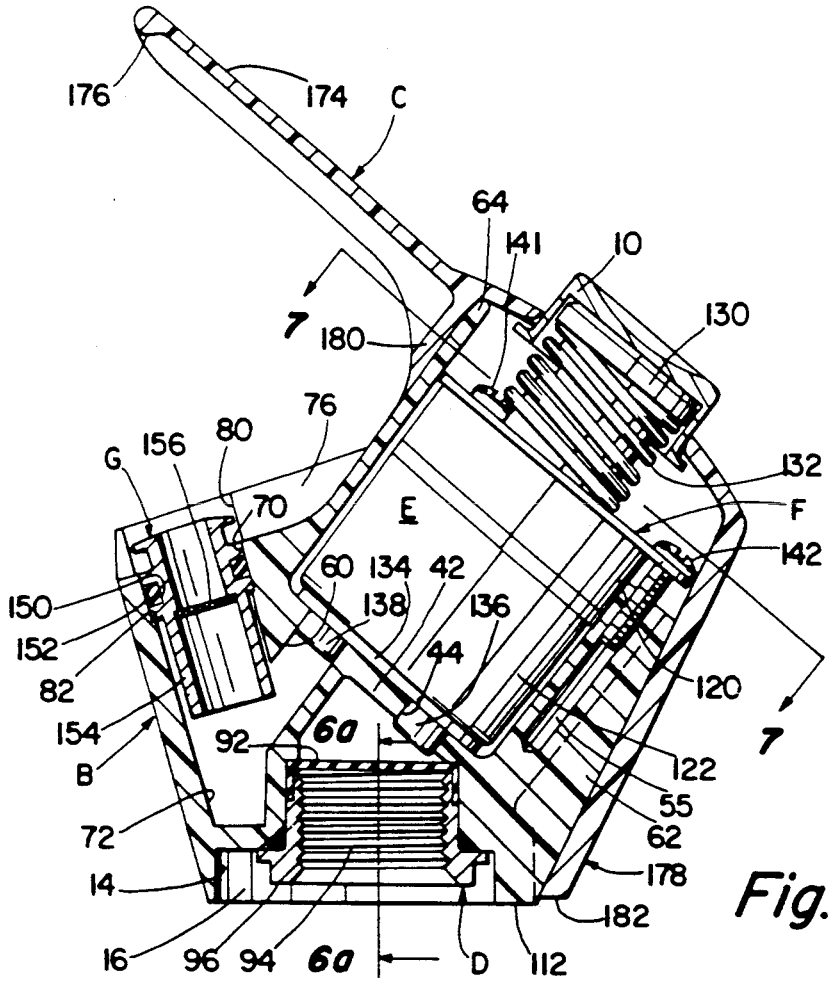
FIG. 6 is a cross-sectional elevational view similar to FIG. 5, and showing a metal mounting base, a flow regulator and an outlet spout assembled to the plastic valve body.
Figure 6A:
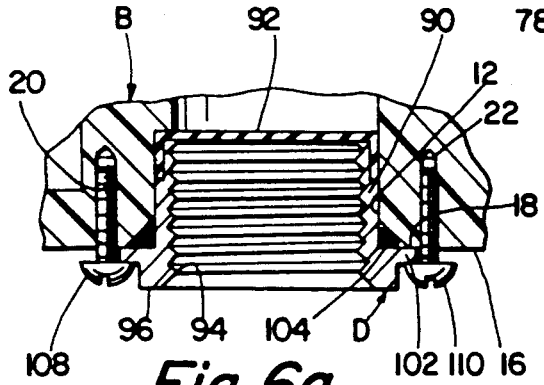
FIG. 6*a* is a partial cross-sectional elevational view taken generally on line 6*a*—6*l* of FIG. 6.
Figure 8:
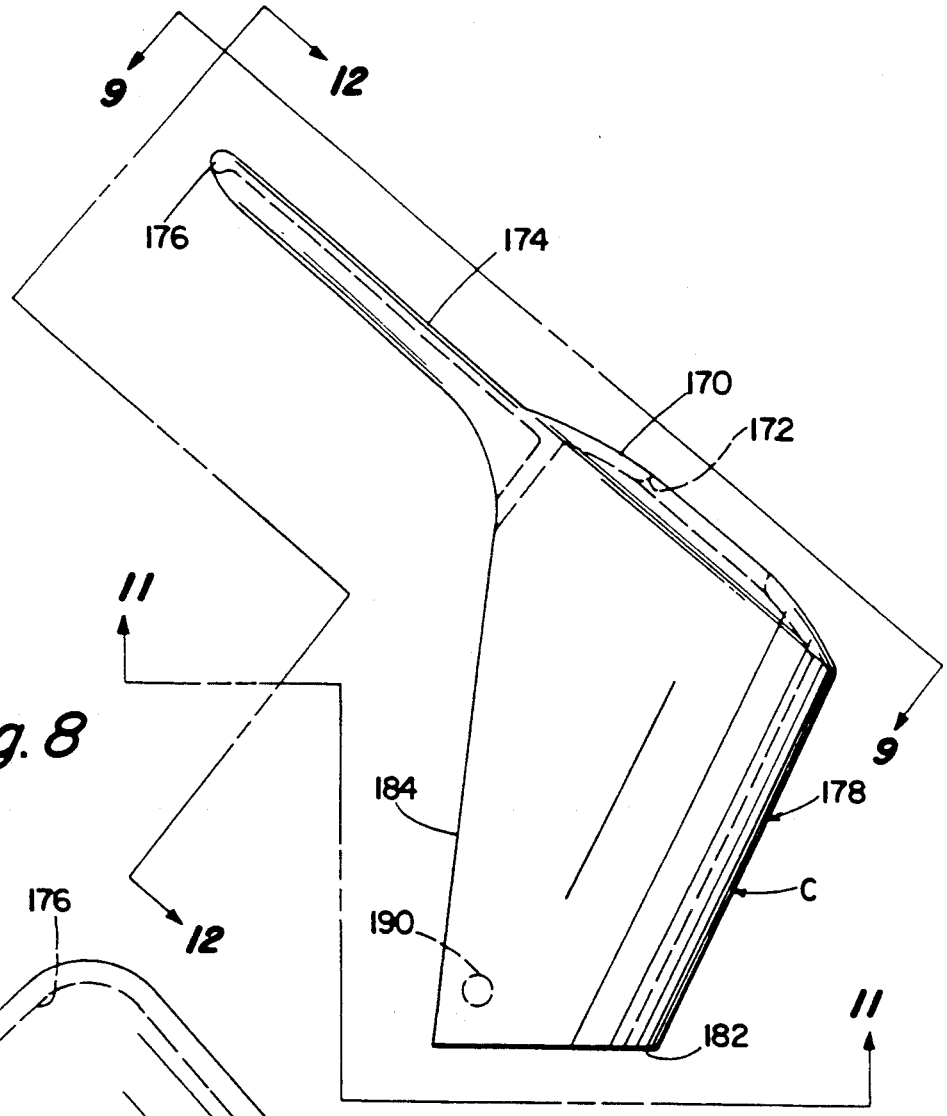
FIG. 8 is a side elevational view of a shield.
Figure 9:
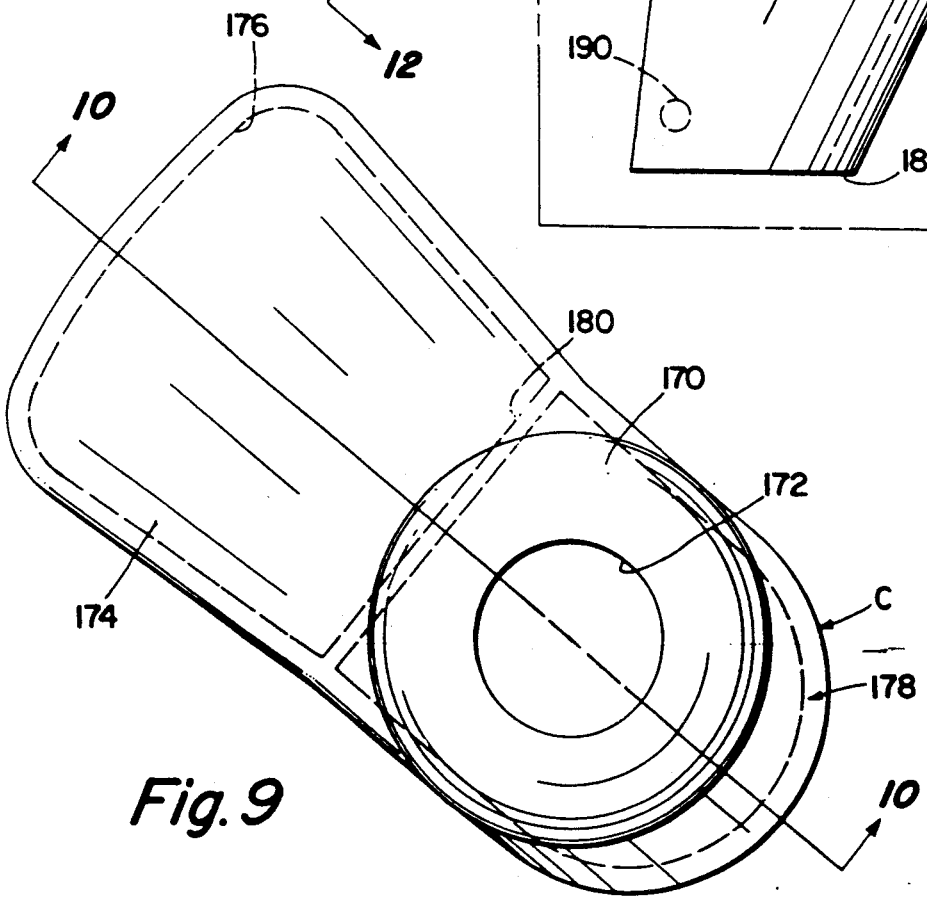
FIG. 9 is a plan view taken generally on line 9—9 of FIG. 8.

Referring to FIGS. 6 and 6*a*, a metal mounting base D has a cylindrical sleeve portion 90 with a relatively smooth cylindrical outer surface closely received in cavity 12. The terminal end portion of sleeve portion 90 has a reduced diameter to provide a circumferential recess for receiving the peripheral wall on a cup-like filter screen 92. The interior of metal mounting base D is internally threaded as indicated at 94 for receiving a water supply fitting on a water fountain. A flat circumferential seat 96 on metal mounting base D is adapted to cooperate with a gasket positioned against same and against another seat on a water supply fitting.

An outwardly extending circumferential flange 102 on metal mounting base D is spaced from flat end seat 96 and engages shoulder 16. An elastomeric O-ring 104 is positioned on mounting base D at the intersection of sleeve portion 90 and flange 102. O-ring 104 sealingly engages chamfer 18. Self-tapping retaining screws 108, 110 are threaded into holes 20, 22. The enlarged heads on retaining screws 108, 110 engage flange 102 on mounting base D for securely clamping same against shoulder 16, and for firmly compressing O-ring 104 between chamfer 18 and the metal mounting base. As shown in FIG. 6, end seat 96 on mounting base D is spaced upwardly into recess 14 from flat circumferential bottom 112 of valve body B.

Referring to FIG. 6, a flow regulator cartridge E is received in the pocket previously described with reference to FIG. 5. Flow regulator cartridge E may be of any known type, including the type disclosed in U.S. Pat. No. 3,902,600 issued Sept. 2, 1975, to Turner, et.al. The outer shell of flow regulator cartridge E has large and small diameter portions 120, 122. The inwardly facing surfaces of bosses 50–52 of FIG. 4 lie on the periphery of circles, and are stepped as indicated at 124, 126 for boss 52 in FIG. 5. The two circles on which the two stepped surfaces of the bosses lie have approximately the same diameters as the large and small diameter portions 120, 122 of flow regulator cartridge E. Therefore, the outer shell of flow regulator cartridge E makes substantially line contact with bosses 50–52 along two different diameter circles.

Flow regulator cartridge E has a reciprocating plunger 130 for selectively opening and closing a valve, and is normally biased to a closed position by coil spring 132. An elastomeric gasket 134 is positioned between the bottom of flow regulator cartridge E and wall 42 on plastic valve body B. Gasket 134 has openings therethrough aligned with inlet and outlet openings 44, 60. Flow regulator cartridge E has inlet and outlet nipples 136, 138 extending through the openings in the gasket and are received in inlet and outlet openings 44, 60.

Figure 7:
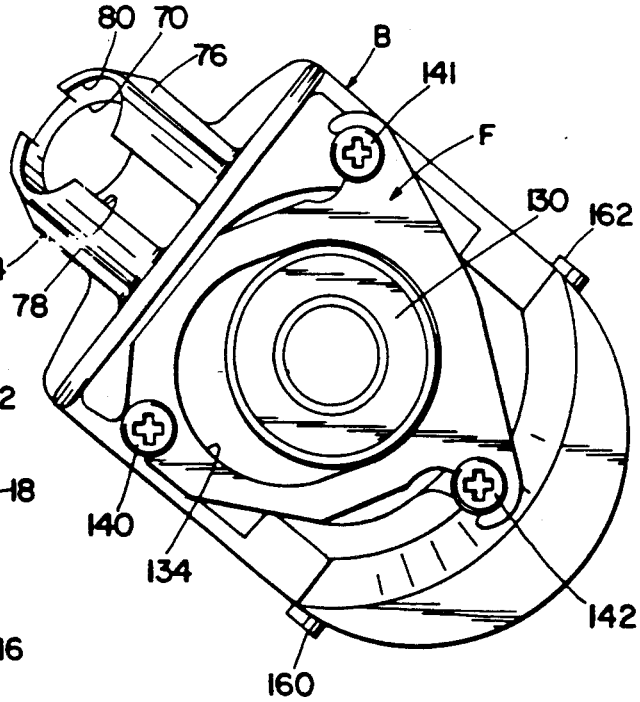
FIG. 7 is a plan view taken generally on line 7—7 of FIG. 6 with portions removed for clarity of illustration.

A flat metal retainer plate F in FIG. 7 has a laterally elongated hole 134 therethrough received over plunger 130. Retainer F is positionable against the outer terminal ends of bosses 50–52 of FIG. 4, and has laterally open slots therein alignable with holes 53–55 in such bosses. The laterally open slots and holes 53–55 receive self-tapping holding screws 140–142 that cooperate with retainer F for holding flow regulator cartridge E in the pocket in valve body B. Retainer F engages the upper end of the shell or housing of the flow regulator cartridge for compressing gasket 134 between the bottom of the cartridge and wall 42. All of the screw receiving slots in retainer F open laterally in substantially the same direction so that screws 140–142 can be slightly loosened to allow lateral movement of retainer F generally to the right and slightly upwardly in FIG. 7 for freeing the retainer. This allows removal of same and of the flow regulator cartridge without completely removing the screws. The laterally elongated opening 134 allows lateral movement of retainer F relative to flow regulator plunger 130.

FIG. 6 shows an outlet spout G having a cylindrical portion closely received in bore 70 in valve body B. A circumferential groove 150 in outlet spout G receives an elastomeric O-ring 152 that extends outwardly of the groove in its relaxed condition, and is a compressive fit within bore 70 for retaining outlet spout G in bore 70. Outlet spout G bottoms out against shoulder 82 between bore 70 and flow passage 72 for proper positioning of outlet spout G. An integral extension sleeve 154 on outlet spout G extends into flow passage 72, and receives a filter screen 156 and a suitable stream straightener of a known type. As shown in FIG. 6, the upper end of outlet spout G is spaced below the outer ends of channel forming walls 74, 76. Therefore, it is extremely difficult for someone to block the outlet spout because it is recessed below the outer surfaces of walls 74, 76 on valve body B. In addition, cylindrical recess 80 communicates with the open channel between walls 74, 76. If recess 80 is blocked, water can still flow from spout G through channel 78 between channel forming walls 74, 76.

Referring to FIG. 6, with metal mounting base D threaded on a water supply fitting on a water fountain, water is supplied to inlet nipple 136 on flow regulator cartridge E. Depressing button 10 and plunger 130 opens an internal valve within flow regulator cartridge E to provide flow of water through outlet nipple 138 into flow passage 72. Water can then flow through outlet spout G. Releasing the force on button 10 and plunger 130 allows spring 132 to return same and the internal valve to a closed position.

Referring to FIGS. 2, 3, 4 and 7, a pair of oppositely disposed circular lugs 160, 162 extend outwardly on opposite sides of plastic valve body B. Cylindrical lugs 160, 162 are completely spaced along the exterior surface of valve body B from bottom end 112 thereof. Lugs 160, 162 are adapted to retain a shield on valve body B, and the shield is described with reference to FIGS. 8–12.

Shield C has a cover portion 170 with a central opening 172 therethrough for receiving button 10 of FIG. 6. An elongated thin shield tongue 174 projects outwardly from cover portion 172 for generally overlying outlet spout G as shown in FIG. 6. Elongated tongue 174 is generally flat but slightly curved transversely, and might be said to have a duck bill shape. The outer periphery of tongue 174 is provided with a smoothly rounded bead 176 to eliminate any sharp edges on the tongue. Shield C is molded of any suitable synthetic plastic material, such as ABS, compounded to have some flexibility. Also, shield tongue 174 is very thin to allow some flexibility to prevent injury to a person accidentally striking same.

A peripheral wall 178 projects downwardly from cover portion 170 to define a valve body receiving cavity. Peripheral wall 178 is circumferentially continuous adjacent cover portion 170, and includes a flat peripheral wall portion 180 between cover portion 170 and shield tongue 174. Peripheral wall 178 has a terminal end portion 182. Between the circumferentially continuous portion of peripheral wall 178 adjacent cover portion 170 and terminal end 182, peripheral wall 178 has a generally U-shaped cross-sectional configuration. The generally U-shaped portion of the peripheral wall is generally indicated at 184. A pair of circular recesses 190, 192 in the internal surfaces of U-shaped portion 184 are adapted to closely receive lugs 160, 162 on valve body B. Circular recesses 190, 192 are located adjacent terminal end 182 but are completely spaced therefrom along the inner surface of U-shaped portion 184.

The interior of peripheral wall 178 is shaped and dimensioned for close reception over valve body B. Thus, flat peripheral wall portion 180 on shield C is closely received against wall 64 on valve body B as shown in FIG. 6. Likewise the rear portion of shield peripheral wall 178 is closely received against reinforcing rib 62 on valve body B as shown in FIG. 6. The opposite sides of generally U-shaped portion 184 of shield C are likewise closely received against the opposite sides of valve body B. Shield 182 is moved downwardly over valve body B until bottom terminal end 182 thereof engages lugs 160, 162. Suitable tools are then used for prying the opposite walls of shield U-shaped portion 184 away from one another for reception over lugs 160, 162 so that shield C can be moved downwardly further until shield recesses 190, 192 closely snap over lugs 160, 162. This retains shield C to valve body B against removal of same. However, a skilled repair person can pry the opposite walls of U-shaped shield portion 184 outwardly to free lugs 160, 162 from recesses 190, 192 for removing the shield to make repairs to the bubbler.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A plastic valve body having an outwardly opening cavity for receiving a metal mounting base, a plurality of circumferentially-spaced retaining screw receiving holes in said valve body outwardly of said cavity for receiving screws to secure a metal mounting base in said cavity, said valve body having a circumferential bottom surface spaced outwardly from said cavity and from said screw receiving holes in directions both axially and radially of said cavity to provide internal space for accommodating a mounting base and retaining screws without having same project outwardly of said valve body beyond said bottom surface thereof.

2. The valve body of claim 1 including a shoulder around said cavity, and a circumferential chamfer between said shoulder and said cavity, said screw receiving holes being in said shoulder outwardly of said chamfer.

3. The valve body of claim 1 including a cylindrical bore for receiving an outlet spout, an outlet spout shaped for close sliding reception within said bore, a circumferential seal receiving groove in said spout, an O-ring in said seal receiving groove, said O-ring being compressed between said bore and said spout and comprising the sole means retaining said spout in said bore.

4. The valve body of claim 1 including a bore shoulder in said bore, said spout being bottomed out against said bore shoulder.

5. The valve body of claim 1 including an opening aligned with said cavity and being surrounded by a flat circular end surface, said valve body having an external surface, and a pair of opposite shield retaining lugs extending outwardly from said external surface and being completely spaced along said external surface from said flat end surface.

6. The valve body of claim 5 including a plastic shield having a flexible generally U-shaped portion configured for close reception around said valve body, and a pair of opposite lug receiving recesses in said U-shaped portion receiving said lugs for retaining said shield on said valve body.

7. The valve body of claim 1 and further including an outwardly opening pocket for receiving a flow regulator, and a plurality of circumferentially-spaced holding screw receiving holes around said pocket for receiving screws to hold a flow regulator in said pocket.

8. The valve body of claim 7 wherein said pocket is defined within at least three circumferentially-spaced bosses, said holding screw receiving holes being in said bosses, and said pocket being laterally open between adjacent ones of said bosses.

9. The valve body of claim 7 including a flow regulator received in said pocket, a retainer positioned over said flow regulator, and holding screws threaded into said screw receiving openings in holding relationship to said retainer for holding said flow regulator in said pocket.

10. The valve body of claim 1 including an internally threaded metal mounting base closely received in said cavity, screws threaded into said screw receiving holes in cooperating relationship with said mounting base for securing same within said cavity, said mounting base and said screws being located entirely within said internal space such that no portion thereof projects outwardly beyond said bottom surface of said valve body.

11. The valve body of claim 10 including a shoulder surrounding said cavity, said mounting base having an outwardly extending flange engaging said shoulder.

12. The valve body of claim 11 wherein said screws have screw heads bearing against said flange for clamping same against said shoulder.

13. The valve body of claim 11 including an elastomeric seal positioned between said valve body and said flange on said mounting base.

14. The valve body of claim 13 including a circumferential chamfer between said shoulder and said cavity, said mounting base having a sleeve portion received in said cavity, said seal comprising an O-ring positioned around said sleeve portion at the intersection thereof with said outwardly extending flange, and said O-ring being in engagement with said chamfer.

15. The valve body of claim 14 wherein said screws have screw heads bearing against said flange for clamping same against said shoulder.

16. A plastic valve body having at least three circumferentially-spaced axially elongated bosses within which a pocket is defined for receiving a flow regulator, each said boss having a holding screw receiving hole therein for receiving a screw to hold a flow regulator in said pocket, said valve body being laterally open outwardly between adjacent ones of said bosses.

17. The valve body of claim 16 wherein said pocket is laterally open between adjacent ones of said bosses.

18. The valve body of claim 16 including a flow regulator received in said pocket, a retainer positioned over said flow regulator, and holding screws threaded into said holding screw receiving holes in cooperative relationship wit said retainer for holding said flow regulator in said pocket.

19. The valve body of claim 18 wherein said retainer has laterally open slots through which said holding screws extend, all of said slots opening laterally in substantially the same direction.

* * * * *